US006634436B1

(12) United States Patent
Desai

(10) Patent No.: US 6,634,436 B1
(45) Date of Patent: Oct. 21, 2003

(54) MOBILE LAND DRILLING APPARATUS AND METHOD

(75) Inventor: Vinod Desai, Houston, TX (US)

(73) Assignee: National Oilwell, L.P., Houston, TX (US)

( * ) Notice: Subject to any disclaimer, the term of this patent is extended or adjusted under 35 U.S.C. 154(b) by 0 days.

(21) Appl. No.: 09/544,577

(22) Filed: Apr. 6, 2000

(51) Int. Cl.[7] ..... E21B 7/00

(52) U.S. Cl. ..... 173/1; 173/28; 173/184; 173/186

(58) Field of Search ..... 173/1, 28, 184, 173/186

(56) References Cited

U.S. PATENT DOCUMENTS

| | | | | | |
|---|---|---|---|---|---|
| 3,922,825 | A | | 12/1975 | Eddy et al. | 52/116 |
| 3,942,593 | A | | 3/1976 | Reeve, Jr. et al. | 173/86 |
| 4,138,805 | A | * | 2/1979 | Patterson | 52/116 |
| 4,258,796 | A | * | 3/1981 | Horning et al. | 173/147 |
| 4,269,395 | A | * | 5/1981 | Newman et al. | 173/147 |
| 4,290,495 | A | * | 9/1981 | Elliston | 166/77.4 |
| 4,368,602 | A | * | 1/1983 | Manten | 173/28 |
| 4,899,832 | A | * | 2/1990 | Bierscheid, Jr. | 173/184 |

* cited by examiner

*Primary Examiner*—Scott A. Smith
*Assistant Examiner*—Nathaniel Chukwurah
(74) *Attorney, Agent, or Firm*—Stevens, Davis, Miller & Mosher, LLP

(57) ABSTRACT

A mobile land rig and method are disclosed, for the transport, assembly, and disassembly of oil drilling equipment. A mobile telescoping substructure box includes at least one axle and coupled wheels lockable and releasable for engaging the ground and being raised above the ground and for supporting a mobile drill mast. A lifting means selectively supports the mobile telescoping substructure box unit in a raised position and lowered position with respect to the ground. An extension cylinder further extends the mobile telescoping substructure box unit in telescopic extension. A stationary frame member and a telescoping frame member comprising the mobile telescoping substructure box unit have a plurality of cables attached thereto for supporting the telescoping frame member when extended. Limit switches attached between the cables and frame members sense when cable tension reaches predetermined limits and generate a stop signal. Telescopic extension of the telescoping frame member is stopped in response to the stop signal. Stop pins are further engaged in response to the stop signal to support the telescoping frame member in the extended position. Trolley winch allows completion of rig assembly without external crane.

31 Claims, 5 Drawing Sheets

32
32a 30
32b
34

21
28
21a
29
21b
26
18d
18
18e
21d
14a
21c
23
14
14
18b
18a
18c
12a

MOBILE LAND DRILLING APPARATUS AND METHOD

FIELD OF THE INVENTION

The present invention is in the field of oil exploration and drilling. In particular, the present invention is a mobile land rig and method for the rapid placement, assembly, disassembly, and repositioning of an oil drilling rig and associated drilling equipment.

BACKGROUND OF THE INVENTION

Conventional oil drilling and exploration in major land drilling operations require the rapid deployment, assembly and disassembly of drilling structures. Consequently, the transportability of components and the speed at which components can be assembled with the minimum amount of auxiliary equipment are paramount concerns. A transportable oil drilling rig typically includes, for example, a support base, a mast, pipe sections, and a drill floor. Often times however, auxiliary support equipment such as cranes are required to facilitate the setup and takedown of large components such as the base, the drill floor, the pipe racking board, and the like having the effect of increasing operational costs.

Drilling sites are often located in remote areas requiring truck transportation of the components of the rig accompanied by equipment used to assemble the rig. Further complicating the rig assembly process is the persistent need to change locations once a hole is sunk and it is determined whether the site will be sufficiently productive to merit a pumping installation, whether the site will be unproductive all together, or whether a more ideal location exists to sink a hole. Typically, site changes can occur once every several months, and, in response, prior art systems have attempted to increase the degree of mobility of rig components. Auxiliary equipment however is still necessary for performing steps such as placing the drill floor.

Since the variable costs associated with leased support equipment, such as cranes and the like, are calculated on a per hour or per day basis, expediting the takedown, transport, and setup operations is crucial for minimizing equipment leasing costs. Typical takedown and setup time is in the order of days. With equipment leasing costs ranging from several hundred dollars per day or more, many thousands of dollars in costs may be incurred for each end of a setup and takedown operation. For larger or more complex rigs, the cost may be even higher. In general, prior art drilling rigs are geared towards facilitating rapid setup, takedown and transport but still require external cranes, external winches, and the like which are most often leased increasing overall expense.

One such prior art system for erecting an oil well derrick is shown in U.S. Pat. No. 3,922,825 issued to Eddy's et al on Dec. 2, 1975. Eddy's system employs a stationary substructure base and a movable substructure base mounted thereon. Eddy's movable substructure base is coupled to the stationary base but swings upright into an elevated position on a series of struts that are connected to the stationary base with swivel connections at each end. Eddy's movable base is otherwise stationary given that neither the stationary base nor the "movable" base are mobile or repositionable without the use of an auxiliary crane or the like. Moreover, simply raising the movable substructure base and the drill mast requires the use of a winch mounted on an auxiliary winch truck.

Another prior art system for assembly of a drill rig is shown in U.S. Pat. No. 3,942,593 issued to Reeve, Jr., et al on Mar. 9, 1976. The mobile well drilling rig apparatus shown in Reeve comprises a trailerable telescoping mast and a separate sectionable substructure assembly further comprising a rig base, a working floor, and a rail means. The mast is conveyed to the top of the substructure by rollers and may be raised by hydraulic raising means to the upright position. Some of the disadvantages of such a system are the sheer length of the mast assembly when transporting and the instability of the mast while raising. A further disadvantage of the system of Reeve is the need for drawlines and winch means to raise the mast onto the working floor.

In addition to the need for auxiliary equipment such as winch trucks and the like, each of the above mentioned systems requires some stationary substructure that must be set down prior to the imposition of any additional structure thereupon. Further movement or repositioning of the base structure requires cranes or other heavy equipment to effect movement even in the case of the purported "movable" base structure of Eddy.

OBJECTS OF THE INVENTION

It would be desirable therefore for a mobile land rig that was self sufficient thus capable of being transported, erected, and disassembled without the need for auxiliary equipment. Such a system would save costs associated with leasing cranes and the like for periods of days during erection and disassembly of rigs.

It would further be desirable for a system with a self contained substructure base capable of being easily moved. Such a system would allow rapid placement and repositioning of the substructure base without the need for a crane or the like.

It would still further be desirable for a system having a substructure base that could be telescoped to a maximum operating height and automatically secured at such height yet possess structural rigidity sufficient to withstand winds and like forces incumbent on the mast structure. Further, the desirable system would be able to be collapsed to a minimum height to facilitate transport. Such a system would allow the substructure base to be easily transportable when collapsed yet sufficiently tall to support a drill mast when telescoped.

It would still further be desirable for a system capable of winching components into place with a self contained winching platform located on the drill mast. Such a system would allow rig components to be placed without the need for auxiliary equipment such as an external crane or winch.

It would be still further desirable for a system wherein all system components could be easily trailerable and transportable by truck. Such a system could be easily moved from one site to another with a minimum of setup and takedown time.

SUMMARY OF THE INVENTION

To meet the objects of the invention, a mobile land rig is provided for the transport assembly and disassembly of oil drilling equipment. The mobile land rig of the present invention comprises a mobile telescoping substructure box having wheel means integrated therein capable of supporting the mobile telescoping substructure box in rolling relation to the ground or drilling platform surface during transport. The mobile telescoping substructure box in the lowered position facilitates assembly of the mobile telescoping substructure box and the drill mast prior to and during mast erection. The mobile telescoping substructure box is typically raised into the fully extended position once the drill mast is fully erected as described hereinafter.

In the present invention, two such mobile telescoping substructure boxes are used to establish the base for the drill mast. The wheel means for allowing the mobile telescoping substructure box to roll may consist of one or more axle wheel assemblies preferably equipped with conventional heavy duty pneumatic rubber truck tires. The wheel means may further be provided with a selective raising and lowering means, such as a hydraulic lift, within the mobile telescoping substructure box to selectively engage and disengage the wheel assembly with a ground surface by lifting and lowering the substructure box in relation to the wheel means. When the mobile telescoping substructure box is correctly rolled into position, for example, the wheel assembly can be raised relative to the mobile telescoping substructure box and thereby establish direct contact between the ground and support footings or a support frame of the mobile telescoping substructure box. The support frame, in addition to bearing the load of the mobile telescoping substructure box and all structure attached thereto, may be equipped with load leveling means to ensure that the mobile telescoping substructure box is placed on the level.

The mobile telescoping substructure boxes comprise an inner and an outer frame section with the inner frame section nested inside the outer and coupled to the outer frame section by cables. The frame sections may be made from suitable structural, metal, such as steel, with sufficient strength to support the drillworks, racking board, drill floor, drill mast, and the like. To facilitate telescopic extension of the mobile telescoping substructure box while maintaining structural integrity thereof, the inner frame may be rigged with cables made from steel or suitably strong material.capable of withstanding loads generated during rig construction and erection, loads generated from lateral forces such as wind, or loads generated from objects suspended from the drill mast. Such cables may be coupled to the inner frame and the outer frame such that when the frame reaches maximum extension, the cables are drawn taught in a predetermined pattern that enhances the structural characteristic of the mobile telescoping substructure box. Such a pattern may, for example, be a simple crisscross pattern such that lateral forces impinging on one side of the structure are translated through the cable configuration to the opposite side of the structure. In addition to providing support, the cables may be provided with limit switches to signal that the inner frame has reached maximum excursion. Further, turnbuckles may be provided to adjust the cables for the proper tension.

Stop pins are provided on the outer frame section of the mobile telescoping substructure box to secure the inner frame section in the fully extended position. When the mobile telescoping substructure box reaches maximum extension, the stop pins are engaged with stop pin activating means, preferably being hydraulically activated, through the supporting structure of the extended inner frame section to lock the extended inner frame section in place. Stop pins are engaged in response to tension limiters coupled to the cables and capable of sensing when the tension on the cables reaches a predetermined tension value. Such a predetermined tension value is indicative of the full extension of the extended inner frame section. Tension limiters coupled to the cables then signal the hydraulically activated stop pin activating means. The stop pins and activation means may be attached to the outer frame section and may be extended through openings in the outer frame section when engaged. The stop pins support the inner frame in the fully extended position thus facilitating load bearing and preventing retraction of the inner frame into the outer frame section.

To facilitate telescoping and provide guidance and structural support during telescoping, the inner frame may further be located within an enclosed frame rail, guide rail, or like structure. Rollers located either on the inner or outer frame may be used to facilitate smooth telescoping action and reduce friction between the inner and outer frames of the mobile telescoping substructure box. In the preferred embodiment, the mobile telescoping substructure box is telescoped after assembly and erection of the drill mast.

The drill mast forms another part of the claimed invention, typically comprising, in one embodiment, a bottom mast section and a top mast section both being transportable to the drilling site on separate trailers. The bottom mast section may be placed in proximity to the mobile telescoping substructure box trailers. Drawworks for the rig may be located on a separate trailer and placed on the side of the drill cellar opposite the mast trailer. Hydraulic cylinders are provided on the trailer for raising the bottom mast section into position and pinning the bottom mast section to the two respective mobile telescoping substructure boxes. The bottom mast section may be unlinked from the trailer by unpinning the mast from the trailer. The bottom mast section may then be linked to the mobile telescoping substructure box and raised into an erect position by a telescoping hydraulic mast raising cylinder. The bottom mast section is further provided with an A-leg that can lower the profile during transport yet be opened upon erection to provide key support for the erected mast.

The top mast section may be coupled to a separate trailer means. During mast assembly, the top mast trailer means may be backed into position in proximity to the bottom mast section and a protruding end section thereof. The top mast section is joined with the bottom mast section to form the complete drill mast. The bottom mast section is equipped with guides at the protruding end section for facilitating alignment of the top and bottom mast sections. The guides are placed on the bottom mast section in the preferred embodiment since the position of the bottom mast section is adjustable and thus can be moved into alignment using the guides to facilitate attachment of the top and bottom mast sections. The hydraulic mast raising cylinder, in addition to raising the mast, allows the bottom mast section to be adjusted in the vertical direction to facilitate aligning and coupling the top and bottom mast sections. Horizontal adjustment of the position of the bottom mast section may be accomplished with a hydraulically, mechanically, or electrically adjusted means such as a turn screw or a drive motor. Since hydraulic power is readily available on the mobile land rig of the present invention, it is the preferred operative means for working devices on and around the rig.

The drill mast may further be provided with a racking board for racking pipe sections, an operation known in the art. The racking board is folded during transport against the top mast section. To provide an advantageous alternative to an external crane, the racking board may further be provided with a winch on the underside thereof traveling via wheel movement along a rail secured to the racking board and provided with a rack gear thereunder. The winch frame is provided with a pinion gear drive powered by a hydraulic driven motor which engages the rack gear and moves the winch back and forth along the track. A cable reeved around a winch on the drawworks trailer runs up through a roller means and down through the winch trolley for raising and lowering loads. The trolley may be positioned inwardly and outwardly along a rail limited by the length of the racking board and any extension added thereto. In the preferred embodiment, the rail would be coextensive with the length of the racking board, but could be extended beyond the racking board length as limited only by the ability of the structure to support the maximum load calculated as a product of load weight and the rail length. Such a winch and trolley may be used, for example, to lift the drill floor into position. The top mast section aft trailer is also provided with hydraulic lift means to raise the top mast portion to a position where it is ready for erection once the top mast section is pinned to the bottom mast section and the top mast section is released from the top mast section forward trailer. The racking board may be extended outwardly from its retracted position along side the top mast section in preparation for mast erection when the top mast section is raised significantly to clear the ground using the lift means on the aft trailer.

DETAILED DESCRIPTION OF THE DRAWINGS

Figure 1:
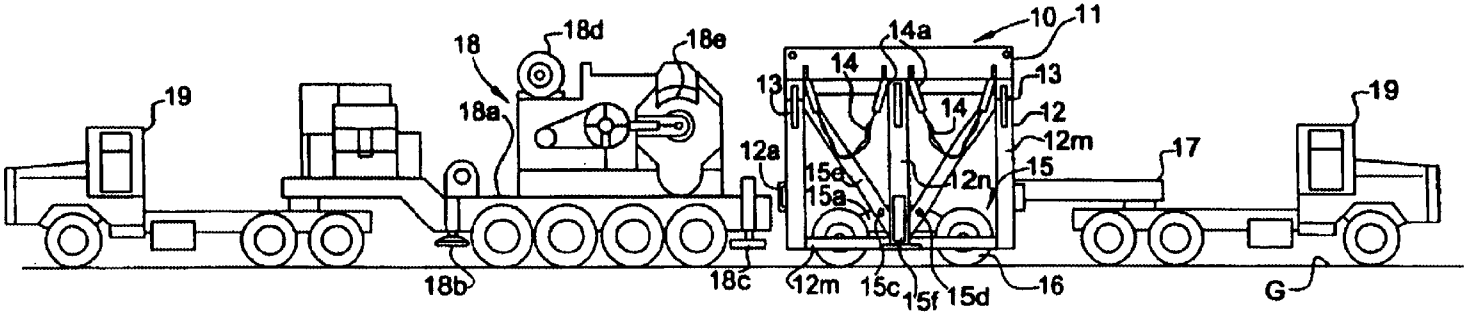
FIG. 1 is a diagram illustrating portions of the present invention including the retracted mobile telescoping substructure box in the transport position, the drawworks and associated trailers.
Figure 5:
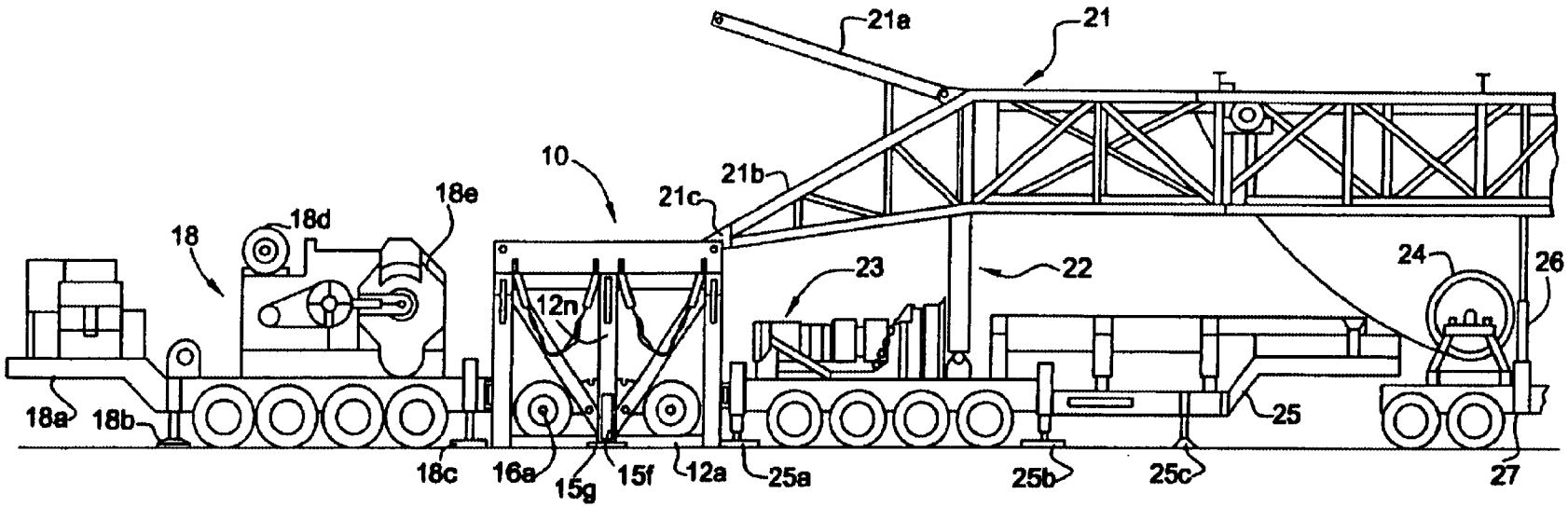
FIG. 5 is a side view of the assembled drill mast lifted into ready position and pinned to the mobile telescoping substructure box.
Figures 6, 7:
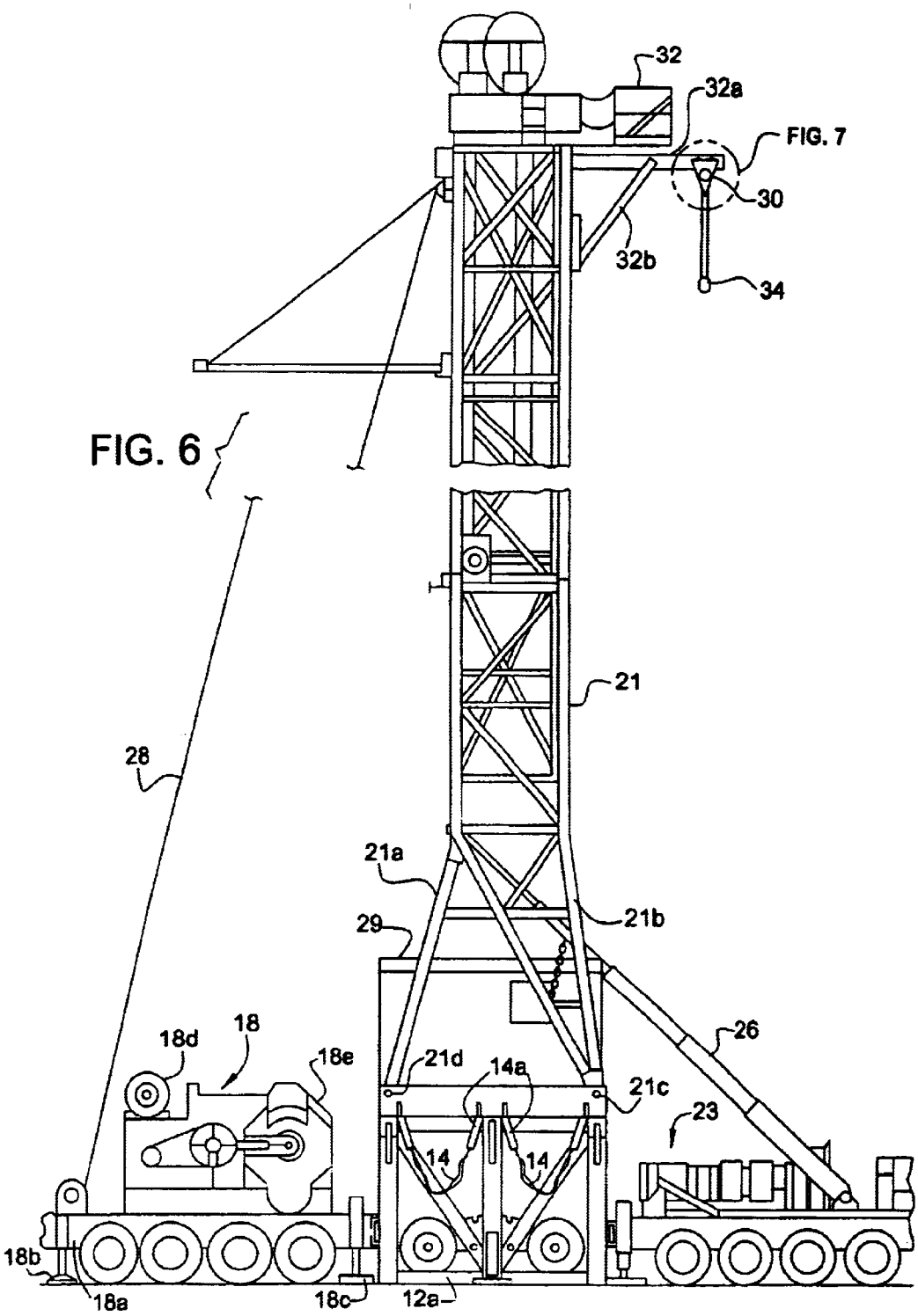
FIG. 6 is a side view of the drawworks, an extended mast raising cylinder and an erected drill mast with a racking board and winch trolley supported on retracted mobile telescoping substructure boxes.
FIG. 7 is a perspective view illustrating the components of the winch trolley of the present invention.
Figure 7:
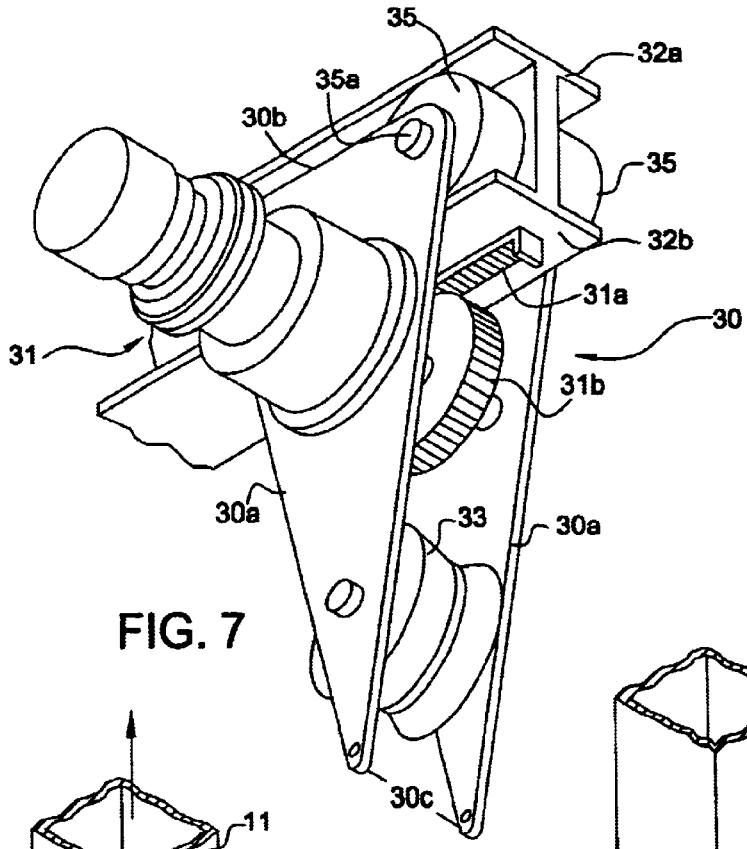

Referring now to the drawings, FIG. 1 and FIGS. 5 and 6 best illustrate the mobile land rig of the present invention comprising an array of modular, transportable components that may be assembled into position to prepare for component placement and rig erection. Primary components of the rig shown in the Figures and described in detail hereinafter include, drawworks 18, mobile telescoping substructure box 10, drill mast 21, racking board 32, and winch trolley 30. All components are transportable and can be assembled without the need for auxiliary equipment at a chosen site. Further, the components are configured to provide the most rapid setup, takedown, and transport possible saving time and costs associated with leased equipment.

As shown in FIG. 1, drawworks 18 carried on trailer 18*a* comprises winch 18*e* powered by a standard 1200 to 1500 horsepower hydraulic power pack 18*d*. Power pack 18*d* provides hydraulic pressure not only for winch 18e but for the working components of the rig described hereinafter. Drawworks 18, via trailer 18*a*, is detachably coupled to road rig 19, a conventional highway truck, and can be drawn into position at the drilling site. Drawworks 18, once placed in position, may be supported on levelers 18*b*, and 18*c* best shown in the load supporting position in FIG. 2. FIG. 1 shows load levelers 18*b* and 18*c* in the retracted position necessary when drawworks 18 is being towed to the drilling site.

Figure 2:
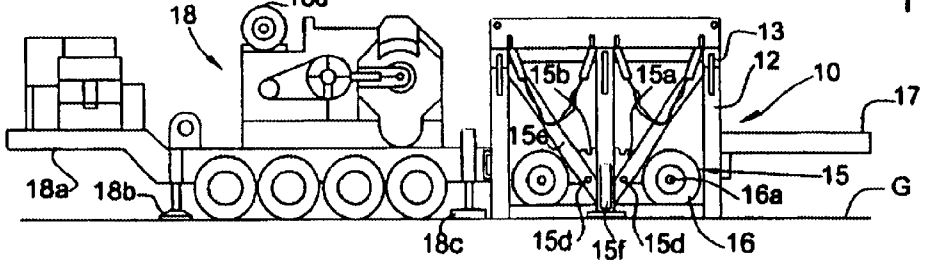
FIG. 2 is a side view of the drawworks and the retracted mobile telescoping substructure box of the present invention in the stationary position.
Figure 3:
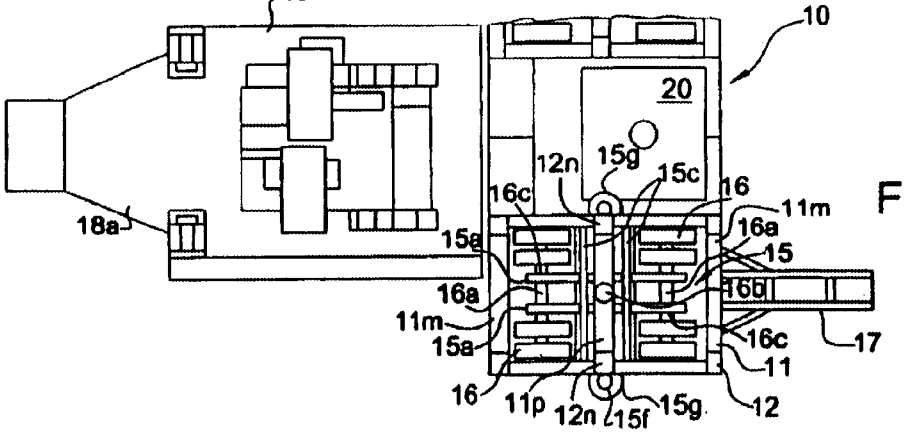
FIG. 3 is a top view of the drawworks, one of two of the mobile telescoping substructure boxes and a partial view of the second mobile telescoping substructure box of the present invention on either side of a drilling cellar.
Figure 1A:
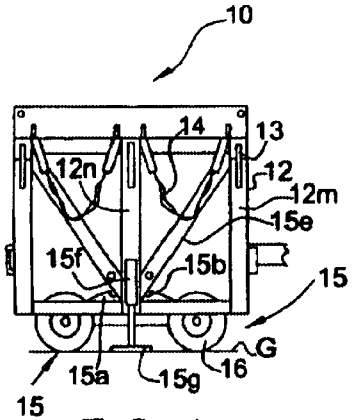
FIG. 1A is a partial side view of the substructure box of FIG. 1 illustrating the raising of the substructure box by lifts to permit the disengagement of the wheel assembly.
Figure 4:
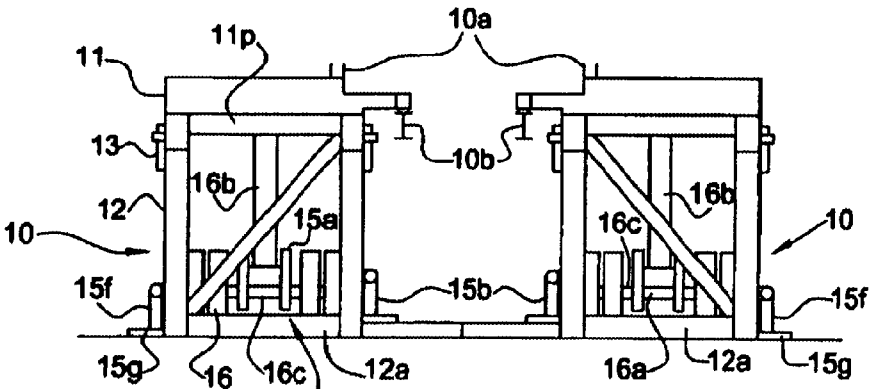
FIG. 4 is an end view of two mobile telescoping substructure boxes positioned on either side of a drilling cellar.

Also shown in the transport position in FIG. 1 is mobile telescoping substructure box 10 for supporting the rig of the present invention. Mobile telescoping substructure box 10 may be transported via tubular inner frame 11 and tubular outer frame 12 composed of a plurality of tubular steel members 11*m* and 12*m* respectively to which is connected towing hitch 17 and an additional road rig 19. Mobile telescoping substructure box 10 is positioned adjacent to drawworks 18 at the drilling site. Inner frame 11 may be referred to as the telescoping frame member and outer frame 12 may be referred to as the stationary frame member. As shown in FIG. 1, mobile telescoping substructure box 10 may be transported with telescoping inner frame 11 fully retracted and may further be transported in a raised position on wheel assembly 15 having wheels 16 on axles 16*a*, 16*a* that are in contact with the ground. The weight of mobile telescoping substructure box 10 is supported on a pair of cross bow members 15*a*, 15*a* journaled at each end 16*c* thereof to axles 16*a*, as shown in FIGS. 3 and 4. Each cross bow member 15*a* is provided with a pair of notches 15*b*, 15*b* in its outer circumference to receive removable support bars 15*c*, 15*c* that pass through suitable openings 15*d*, 15*d* in diagonal steel members 15*e*, 15*e* that are supported on outer frame steel members 12*m*. When installed, as in FIG. 1, the support bars 15*c* support the box structure above the ground. When removed, as shown in FIGS. 1A and 2, the entire support feature of the wheel assembly is deactivated and the box structure rests directly on the ground G. To proceed from the mobile condition of FIG. 1 to the stationary ground engaging position of FIG. 2, separate lifts 15*f*, 15*f* are utilized as shown in FIG. 1A.

These lifts 15*f* having ground engaging feet 15*g* are each positioned on an opposite side of the outer frame 12 and secured to the vertical steel members 12*n*. When operated, to engage the feet 15*g* with the ground G, lifts 15*f* temporarily support the entire substructure 10 as in FIG. 1A at which time support bars 15*c* may be removed because they then support no weight and the wheel assembly 15 is disengaged. When the feet 15*g* are raised relative to substructure 10 from the position in FIG. 1A to that of FIG. 2, the entire substructure 10 is lowered to the ground G as shown in FIG. 2. For best load support of rig structures, two mobile telescoping substructure boxes 10 may be used on either side of drilling cellar 20 as is best shown in FIG. 3 and FIG. 4.

Mobile telescoping substructure box 10 is provided with linking mechanism 12*a* and may be pinned thereby to drawworks trailer 18*a*. In the fully retracted position, inner frame 11 is contained within outer frame 12 as best shown in FIGS. 1, 2, 5, and 6.

The next step in rig assembly is for drill mast 21, shown in FIG. 5, to be brought by trailer 25 into position for erection over drilling cellar 20 and between the substructure boxes on each side thereof and also on the opposite side from drawworks 18. Mast trailer 25 is supported by levelers 25*a*, 25*b*, and 25*c* once drill mast 21 is in position for pinning front mast leg 21*b* at 21*c* to mobile telescoping substructure box 10 at pinning brackets 10*a* on each substructure box 10, as best shown in FIG. 4 and FIG. 5. Drill mast 21 may comprise two sections trailer transported by separately or, as shown in FIG. 5, may comprise a single unit and may be transported already assembled.

To lower the transport profile of drill mast 21, collapsible A-leg 21*a*, provided for supporting drill mast 21 in the raised position but may be collapsed against the side of drill mast 21 during transport. Mast raising cylinders or lifts 22 and 26 support drill mast 21 for subsequent elevation and in a position of alignment with mobile telescoping substructure boxes 10. With mobile telescoping substructure boxes 10 in the retracted position, the alignment operation is greatly simplified and the distance which mast raising lifts 22 and 26 must extend is greatly reduced. Further as shown in FIG. 5, conventional blow-out preventer (BOP) 23 is placed on mast trailer 25 in such a way as to facilitate positioning of BOP 23 over the well center 20 while being suspended from BOP trolleys 10*b* as best shown in FIG. 4.

Figure 8:
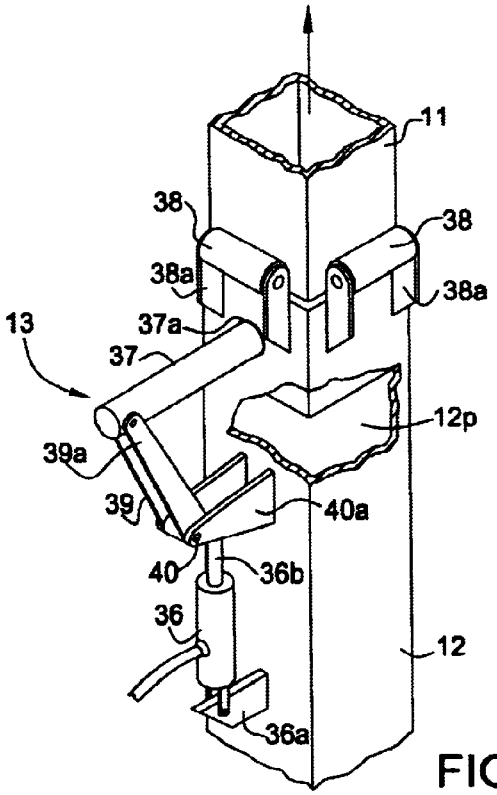
FIG. 8 is a perspective view of the stop pin of the present invention, including hydraulic actuating means, in the disengaged position.

The mobile drill rig of the present invention is adapted to be erected using mast raising cylinder 22 and then mast raising cylinder 26 shown fully extended in FIG. 6. Drill mast 21 is provided with additional accessories such as dog house 29 that may be put into position once drill mast 21 is erected. To provide additional support for drill mast 21 when erected, A-leg 21*a* may be pinned off to mobile telescoping substructure box 10 as shown in FIGS. 6 and 8. With drill mast secured via A-leg 21*a* and the base section 21*b* of drill mast 21 pinned off at 21*d* to mobile telescoping substructure box 10 as shown in FIG. 6, mobile telescoping substructure box 10 may then be extended to the position shown in FIG. 10 through the use of extension cylinder 16*b*.

Figure 9:
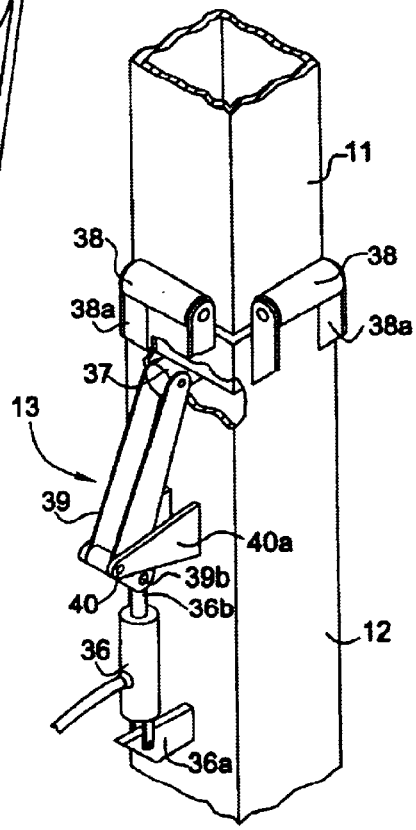
FIG. 9 is a perspective view of the stop pin of the present invention, including hydraulic actuating means, in the engaged position.

Inner frame 11 is disposed within the tubular outer frame 12 in the preferred embodiment, as shown in FIGS. 8 and 9. Outer frame 12 may be provided with rollers 38 positioned at the upper end of outer frame 12 and secured thereto by brackets 38*a*. These rollers facilitate low friction travel of inner frame 11 within the inner surface 12*p* of outer frame 12. The inner frame 11 is therefore stabilized and guided during telescopic extension. Alternatively, rollers 38 may be provided on inner frame 11 for travel within the tubular outer frame 12.

Figure 10:
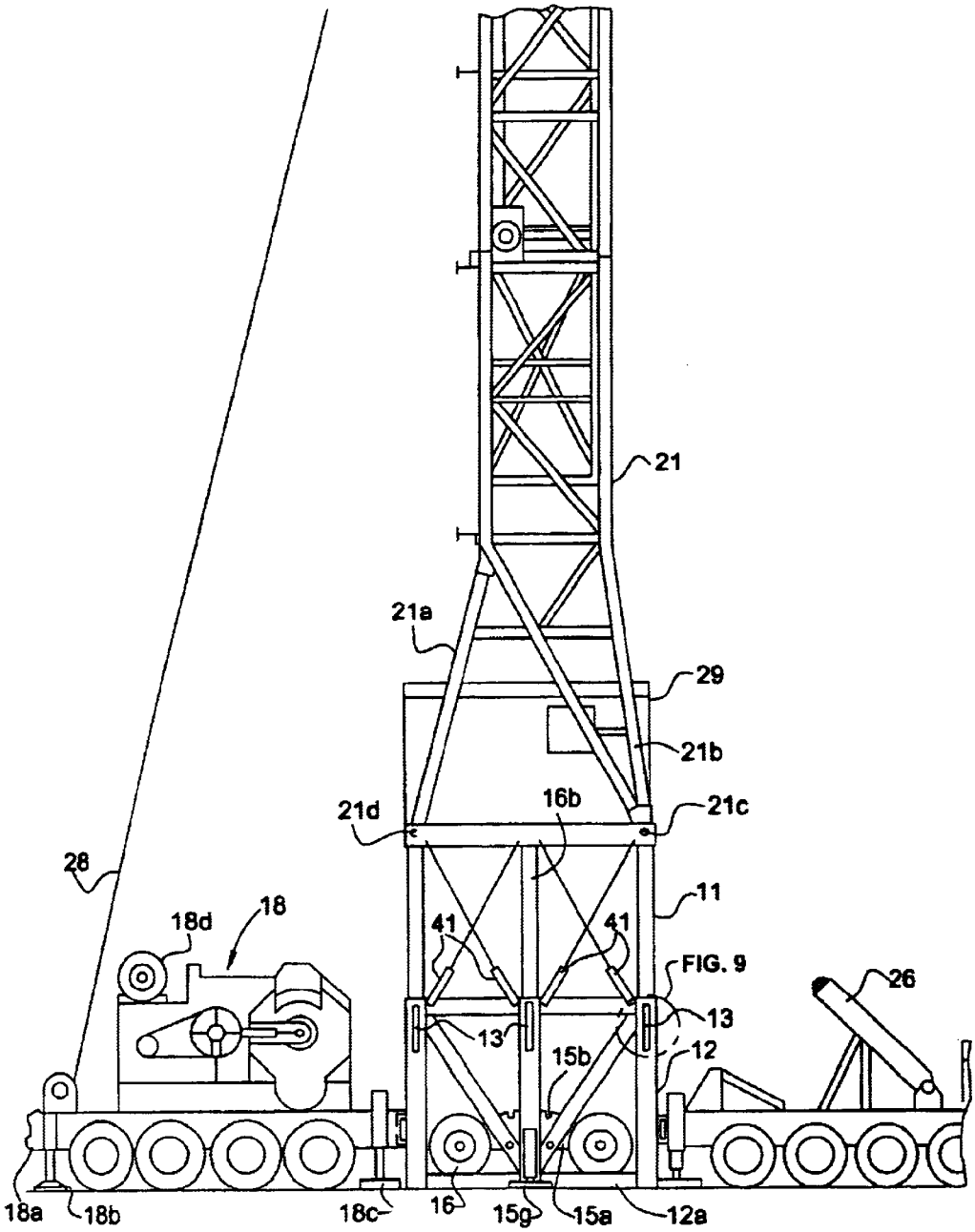
FIG. 10 is a side view of a fully retracted mast raising cylinder, the drill mast and associated equipment supported on fully extended mobile telescoping substructure boxes.

The raising of the substructure box 10 to drill floor height as shown in FIG. 10 utilizes hydraulic cylinders 16*b* that urge cross member 11*p* and therefore the entire inner frame 11 to which it is secured upwardly. To control the extent of the upward movement, inner frame 11 and outer frame 12 are both provided with cables 14 shown in FIGS. 1, 2, 5, 6 and 10 for providing wind support, for instance, for the structure when extended as shown in FIG. 10. Cables 14 are provided with a conventional limit switch 14*a*, of a kind well known in the art. Limit switch 14*a* is sensitive to the tension on cables 14 and can generate a limit stopping signal. Limit switch 14*a* may be a simple tension threshold switch that operates a contact or generates a level upon the occurrence of a predetermined tension level or may output a level corresponding to the tension sensed in cables 14. The level may then be processed by a conventional level comparator circuit or programmed digital comparator. Alternatively, the level may be converted to a digital value then processed directly by a computer based controller.

The signal generated by the operation of limit switch 14*a* in response to a predetermined tension being reached in cables 14, may serve a dual purpose. First the generated signal stops the further flow of hydraulic fluid to the cylinders 16*b* but second it may be used to operate stop pins 13 to positively hold the raised box structure.

Stop pin assembly 13 shown in detail in FIG. 8 and FIG. 9 are for securing inner frame 11 when it is in the fully extended position. FIG. 8 shows stop pin assembly 13 including stop pin activator 36 and stop pin 37 in the disengaged position while FIG. 9 shows stop pin assembly 13 with stop pin activator 36 and stop pin 37 in the engaged position to secure inner frame and outer frame together. Stop pin assembly 13 further includes operating rocker arm 39 with stop pin engaging end 39*a* and ram engaging end 39*b* both operating about pivot 40 journaled within pivot bracket 40*a* secured to the side of outer frame 12. Stop pin activator means 36 in the preferred embodiment is a hydraulic cylinder journaled in support bracket 36*a* with ram 36*b* for engaging operating arm end 39*b* of rocker arm 39 as best shown in FIG. 9. When operated to disengage stop pin 37 from the operative position, pin activator 36 operates ram 36*b* to push against end 39*b* of rocker arm 39 to pull pin 37 out of opening 37*a* in outer frame 12 and a corresponding opening in inner frame 11. Slight hydraulic pressure from extension cylinder 16*b* on inner frame 11 may if desired be applied in the direction of extension to relieve downward pressure on stop pin 37 caused by the weight of inner frame 11 thus allowing stop pin 37 to be more easily withdrawn through opening 37*a*. To engage pin 37, pin activator 36 operates ram 36*b* in the opposite direction and pulls on arm end 39*a* to push pin 37 into opening 37*a* in both the inner frame 11 and outer frame 12. Both insertion and removal operations of pin, 37 are best performed with a slight overextension of inner frame 11 as described.

In the fully extended position, mobile telescoping substructure box 10 may support drill mast 21 and, via racking board 32 and winch trolley 30, the erected mobile land rig of the present invention can bear loads when acting in a crane capacity to complete rig assembly, and is further prepared for subsequent normal drilling operations.

As shown in FIG. 6 and FIG. 7, racking board 32 includes steel I-beam 32*a* therebelow for winch trolley 30 to travel upon. Bracket 32*b*, secured on one end to drill mast 21 and on the other end to beam 32*a*, provides additional structural support for lifting operations conducted with block 34 coupled to cable 28 reeved around pulley 33 and is shown in FIG. 6 and in greater detail in FIG. 7. Winch trolley 30 comprises a hydraulic motor 31 driving pinion gear 31*b* on rack gear 31*a* to move winch trolley 30 along beam 32*a* on rollers 35. Triangularly shaped clamp brackets 30*a*, 30*a* are located on either side of I-beam 32*a* for supporting winch trolley 30 using journaled rollers 35 at its base 30*b*. Pulley 33 is positioned between the apecies 30*c*, 30*c* of the triangularly shaped clamp brackets 30*a*. The rollers 35 are secured to clamp brackets 30*a*, 30*a* for rotation about axles 35*a* in order to ride on opposed flanges 32*b*, 32*b* forming I-beam 32*a*. This structure provides adequate structural support for loads lifted using winch trolley 30.

Loads such as the drill floor and the like may be lifted into place or repositioned at any time during operation of the rig obviating the need for an external crane or lift. Moreover, winch trolley 30 may be used to haul pipe sections into place for use during drilling operations further simplifying the drilling operation and reducing the need for support equipment.

From the foregoing detailed description, it will be evident that there are a number of changes, adaptations and modifications of the present invention which come within the province of those persons having ordinary skill in the art to which the aforementioned invention pertains. However, it is intended that all such variations not departing from the spirit of the invention be considered as within the scope thereof as limited solely by the appended claims.

I claim:

1. A mobile land rig, for the erection, transport, and disassembly of oil drilling equipment along the ground, said mobile land rig comprising:

a mobile telescoping substructure box for supporting said mobile land rig;

said mobile telescoping substructure box having at least one axle coupled thereto with each axle having at least one set of wheels for supporting said mobile telescoping substructure box in rolling relation to a ground surface; and a mobile drill mast attachable to said mobile telescoping substructure box for supporting said mobile land rig and said mobile drill mast;

wherein said mobile telescoping substructure box further comprises telescoping means secured to said substructure box for selectively moving said mobile telescoping substructure box between telescoping extension and telescopic retraction, a stationary frame member and a telescoping frame member having a plurality of cables attached thereto between said telescoping frame member and said stationary frame member in a predetermined configuration for supporting said telescoping frame member when said telescoping frame member reaches a maximum telescopic extension.

2. The mobile land rig of claim 1 including, a telescoping frame member having a plurality of cables attached thereto between said telescoping frame member and said stationary frame member in a predetermined configuration for supporting said telescoping frame member when said telescoping frame member reaches a maximum telescopic extension.

3. The mobile land rig of claim 1, wherein each of said plurality of cables comprises a limit switch coupled between an end of said each of said plurality of cables and a frame member responsive to tension imposed thereon for providing a stop signal for stopping the telescopic excursion of said mobile telescoping substructure box.

4. A mobile land rig, for the erection, transport, and disassembly of oil drilling equipment along the ground, said mobile land rig comprising:

a mobile telescoping substructure box for supporting said mobile land rig;

said mobile telescoping substructure box having at least one axle coupled thereto with each axle having at least one set of wheels for supporting said mobile telescoping substructure box in rolling relation to a ground surface; and a mobile drill mast attachable to said mobile telescoping substructure box for supporting said mobile land rig and said mobile drill mast;

wherein said mobile telescoping substructure box further comprises a stop pin controlled by a stop pin activator responsive to a stop signal upon telescopic extension of the substructure box for supporting said telescoping frame member in maximum telescopic extension.

5. The mobile land rig of claim 4, including a racking board secured to said mobile drill mast for supporting loads in lifting relation to said mobile land rig and wherein said board further comprises a winch for hoisting said loads.

6. The mobile land rig of claim 5, wherein said winch further includes a trolley for positioning said winch at a predetermined point along the length of said racking board.

7. The mobile land rig of claim 6, wherein said trolley comprises a rack gear coupled to said racking board and extending a predetermined amount along the length of said racking board and a pinion gear coupled to said winch and engaged with said rack gear.

8. The mobile land rig of claim 5, wherein said trolley further comprises a drive means coupled to said pinion gear for turning said pinion gear and allowing said pinion gear to progressively engage said rack gear along the length thereof.

9. A method for erecting, transporting, and disassembling a drilling rig on the ground, said method comprising:

rolling said drill rig components into proximity with said drilling site on ground engaging wheels, said drill rig components including a mobile telescoping substructure box and a drill mast raising said substructure box relative to said ground engaging wheels, disengaging said wheels from said substructure box lowering said substructure box toward the ground, connecting said drill mast to said mobile telescoping substructure box, raising said drill mast to an upright position, and telescoping said mobile telescoping substructure box into an extended position.

10. The method of claim 9, further including a step of: hoisting said drill rig components into place using hoisting means coupled to said mast.

11. The method of claim 10, further including the steps of:

monitoring said mobile telescoping substructure box rise to an extended position using cables;

sensing a tension value on said cables;

generating a stop signal indicative of a predetermined tension being reached in said cables and said substructure box being in a desired extended position.

12. The method of claim 11, further including the steps of:

stopping said mobile telescoping substructure box unit from being extended in response to said stop signal, and locking said mobile telescoping substructure box unit in an extended position in response to said stop signal.

13. A method for erecting, transporting, and disassembling a drilling rig, said method comprising:

transporting drill rig components to a drilling site using trailer means coupled to said drill rig components, positioning said drill rig components into proximity with said drilling site, said drill rig components including a mobile telescoping substructure box and a drill mast;

connecting said drill mast to said mobile telescoping substructure box;

raising said drill mast to an upright position;

telescoping said mobile telescoping substructure box unit toward an extended position;

monitoring a limit value of said mobile telescoping substructure box rise to an extended limit position, sensing the substructure box rise to said limit value, and generating a stop signal indicative of reaching said limit value and said substructure box being in a desired extended position.

14. A substructure box for supporting a drill mast of a mobile land rig comprising:

mobile means;

a first support structure mountable on said mobile means, displaceable between a first position supported on said mobile means and a second position resting on the ground;

means for selectively displacing said first support structure between said first and second positions thereof;

a second support structure mounted on said first support structure, displaceable between retracted and extended positions and having means for detachably, pivotally connecting a mast thereon angularly displaceable between a lower, transportable position and an erect, operative position, supported on said second support structure, when connected thereto; and means for selectively displacing said second support structure between said retracted and extended positions.

15. A substructure box according to claim 14 wherein said displacing means comprise fluid actuated cylinder assemblies.

16. A substructure box according to claim 14 including means for guiding said support structure along a line of travel when displaced relative to each other.

17. A substructure box according to claim 14 including means for releaseably locking said second support structure relative to said first structure when said second support structure is in said extended position.

18. A substructure box according to claim 14 when said support structures are telescopically connected.

19. A mobile land rig comprising:

a first mobile means including a first support structure mountable on said mobile means, displaceable between a first position supported on said mobile means and a second position resting on the ground, means for selectively displacing said first support structure between said first and second positions thereof, a second support structure mounted on said first support structure, displaceable between retracted and extended positions and means for selectively displacing said second support structure between said retracted and extended positions; and a second mobile means positionable adjacent said first mobile means, having a drill mast mountable thereon including a base portion pivotally connectable to said second support structure of said first mobile means when said second mobile means is positioned adjacent said first mobile means, means for pivoting said drill mast into an upright position supported on said second support structure when said mast is pivotally connected to said second support structure and means for securing said mast on said second support structure when said mast is pivoted into said upright position.

20. A mobile land rig according to claim 19 when said displacing means of said first mobile means comprises fluid actuated cylinder assemblies.

21. A mobile land rig according to claim 19 wherein said substructure box includes means for guiding said second support structure relative to said first support structure along a line of travel when displaced relative to each other.

22. A mobile land rig according to claim 19 wherein said substructure box includes means for releaseably locking said second support structure relative to a said first support structure when said second support structure is in said extended position.

23. A mobile land rig according to claim 19 wherein said support structures of said substructure box are telescopically connected.

24. A mobile land rig according to claim 19 wherein said second mobile means is detachably connectable to said first mobile means.

25. A mobile land rig according to claim 19 wherein said base portion of said mast is provided with a pair of spaced leg sections, one of said leg sections is rigidly connected to a main body portion of said mast and has an end portion detachably, pivotally connectable to said second support structure of said substructure box, and the other of said leg sections is pivotally connected at one end thereof to said main body portion of said mast, allowing said other leg section to collapse when said mast is in a horizontal, transport position, and connectable to said second support structure of said substructure box when said mast is in said upright.

26. A mobile land rig according to claim 19 including a third mobile means supporting a drawworks operatively connectable to said mast.

27. A mobile land rig according to claim 26 wherein said third mobile means is detachably connectable to said first mobile means.

28. A mobile land rig according to claim 19 including a pair of said first mobile means and wherein said mast is pivotally connectable to said second support structures of said pair of said first mobile means, for supporting said mast in an upright position supported on said second support structures, and including means for securing said mast to said second support structures when said mast is disposed in said upright position.

29. A mobile land rig, for the erection, transport, and disassembly of oil drilling equipment along the ground, said mobile land rig comprising:

a mobile telescoping substructure box for supporting said mobile land rig;

said mobile telescoping substructure box having at least one axle coupled thereto with each axle having at least one set of wheels for supporting said mobile telescoping substructure box in rolling relation to a ground surface; and a mobile drill mast attachable to said mobile telescoping substructure box for supporting said mobile land rig and said mobile drill mast;

wherein said mobile telescoping substructure box further comprises a ground engageable lifting means coupled thereto for selectively supporting said mobile telescoping substructure box unit in raised relation to said ground surface and for selectively lowering said mobile telescoping substructure box into contact with said ground surface.

30. A mobile land rig, for the erection, transport, and disassembly of oil drilling equipment along the ground, said mobile land rig comprising:

a mobile telescoping substructure box for supporting said mobile land rig;

said mobile telescoping substructure box having at least one axle coupled thereto with each axle having at least one set of wheels for supporting said mobile telescoping substructure box in rolling relation to a ground surface; and a mobile drill mast attachable to said mobile telescoping substructure box for supporting said mobile land rig and said mobile drill mast;

wherein said mobile telescoping substructure box further includes a support means for locking each axle and each set of wheels to said substructure box when said substructure box is in rolling relation to the ground and for releasing said locking when said substructure box is supported by the ground.

31. The mobile land rig of claim 1, wherein said support means for locking includes a member journaled to each axle and removable means connected to said substructure box and said member.

* * * * *

UNITED STATES PATENT AND TRADEMARK OFFICE

CERTIFICATE OF CORRECTION

PATENT NO. : 6,634,436 B1
DATED : October 21, 2003
INVENTOR(S) : Vinod Desai

It is certified that error appears in the above-identified patent and that said Letters Patent is hereby corrected as shown below:

Column 1,
Line 55, please delete "Eddy's" and insert -- Eddy -- in lieu thereof

Column 10,
Lines 19-20, please delete "said drilling site" and insert -- a drilling site -- in lieu thereof Column 12,
Line 15, please delete "upright" and insert -- upright position -- in lieu thereof Column 13,
Line 3, please delete "1" and insert -- 30 -- in lieu thereof Signed and Sealed this Second Day of March, 2004

JON W. DUDAS
*Acting Director of the United States Patent and Trademark Office*